United States Patent [19]

Sakamaki et al.

[11] 4,075,456

[45] Feb. 21, 1978

[54] HEATING-FIXING DEVICE

[75] Inventors: Hisashi Sakamaki, Yokohama; Toshiyuki Ohtani, Tokyo, both of Japan

[73] Assignee: Canon Kabushiki Kaisha, Tokyo, Japan

[21] Appl. No.: 638,915

[22] Filed: Dec. 8, 1975

[30] Foreign Application Priority Data

Dec. 13, 1974 Japan ..... 49-143280

[51] Int. Cl.[2] ..... H05B 1/00; G03G 15/20

[52] U.S. Cl. ..... 219/216; 219/388; 219/469

[58] Field of Search ..... 219/216, 388, 469–471; 432/59, 60, 227, 228

[56] References Cited

U.S. PATENT DOCUMENTS

| | | | |
|---|---|---|---|
| 2,476,670 | 7/1949 | Lamb | 219/216 |
| 3,359,404 | 12/1967 | Limberger | 219/216 |
| 3,399,292 | 8/1968 | Boldridge, Jr. | 219/469 |
| 3,857,189 | 12/1974 | Katayama et al. | 219/216 X |
| 3,980,863 | 9/1976 | Wulz et al. | 219/216 X |

*Primary Examiner*—C. L. Albritton

*Attorney, Agent, or Firm*—Fitzpatrick, Cella, Harpe & Scinto

[57] ABSTRACT

A heating-fixing device uses a heating member comprising a heat-resistant, insulative substrate and a heating element provided on the substrate. The heating element is arranged obliquely with respect to the direction in which a member to be heated is moved.

6 Claims, 15 Drawing Figures

HEATING-FIXING DEVICE

BACKGROUND OF THE INVENTION

1. Field of the Invention

This invention generally relates to a heating-fixing device. More particularly, it relates to a heating-fixing device having an improved heating member which is applicable in electrophotographic copying machines.

2. Description of the Prior Art

For copying machines, there are generally known some methods which include a method whereby an electrostatic latent image is formed on plain paper coated with a photoconductive material such as zinc oxide or the like and such image is directly developed, and a method whereby an electrostatic latent image is formed on a plate-like or a roller-like photosensitive medium formed of a photoconductive material such as selenium, CdS (cadmium sulfide) or the like and is developed into a visible image, whereafter the visible image is transferred to a separate transfer medium such as paper or the like. One of the important problems common to these electrophotographic copying methods is the heating-fixing step for fixing the developer (or toner) used for the image development.

For example, in a copying machine wherein a visible image formed on a photosensitive plate is transferred to a copying medium (e.g. paper or the like) to provide a transfer image, and if the transfer image consists of thermoplastic resin particles containing coloring pigments, the transfer image is plasticized and softened by being heated, or in the case of a developer (liquid toner) containing coloring pigments and thermoplastic resin in solvent, the particles are given adhesiveness by the solvent being gasified and dried, whereby the particles are coupled together and then solidified upon cooling of the copy medium, thus completing the fixation of the transfer image. Such copying process is completely automated within the copying machine so that the copy medium is conveyed through the machine, repeating meandering and curved motion. Of course, during the step of fixation also, the copy medium in complicatedly curved motion must be heated and fixed while being in such motion. Also, in order to effect heating-fixing most efficiently, it is usually essential that the copy medium be brought into intimate contact with the heat-emitting surface of the fixing device. For this reason, it is sometimes required that the heat-emitting surface of the fixing device be meandering and complicatedly curved. At the same time, the temperature distribution of the heat-emitting surface must be uniform in order to prevent irregular fixation of the copy image, and it is also necessary to provide a desired temperature distribution in accordance with the copy characteristics required. In this manner, a variety of functions are required for the heating-fixing device and in addition, the heating efficiency in the heating-fixing device is an important performance required for the heating-fixation. More specifically, the following requirements are involved:

1. In the heating-fixing device, the time required from after the closing of the main switch till the heating-fixing surface attains a prescribed temperature must be short (good in temperature rise);

2. The heating method must be good in thermal efficiency, because this is indispensable to reduction in power consumption and reduction in size of the copying machine; and 3. A better thermal efficiency must be provided which leads to a smaller size and accordingly, a smaller heat capacity, of the fixing device, which in turn reduces the heat transfer to the surrounding parts apainst their sharp temperature rise, so that the necessity of heat-resisting or adiabatic treatment is eliminated.

Heretofore, a heating member constructed as shown in FIG. 1 of the accompanying drawings has commonly been used in heating-fixing devices.

As shown there, a heat-resistant, insulative substrate 1 such as mica or the like carries thereon a heating element 2 forming a heating circuit of nichrome, the heating element 2 being coated with a heat-resistant, insulative layer 3 of mica or the like, and a plate of metal such as Al, Bs, Fe or the like is further overlaid as a good heat-conductive layer 4 over the layer 3, thereby forming a heating member. Copy medium P, such as photosensitive paper with its surface already developed or transfer medium with developing liquid already transferred thereto passes on the surface of the good heat-conductive layer 4 of the heating member while keeping contact therewith, whereby the developer is heated and fixed.

In such a conventional heating member, the temperature distribution on the surface thereof must be uniform throughout the entire surface area and accordingly, a material of good heat-conductivity, usually, metal, is desired and employed for such surface. However, metal is usually electrically conductive and must therefore be electrically insulated from the heating member, and this necessitates the provision of the heat-resistant, insulative layer 3. Usually, the electrically insulative material is not a good thermal conductor and it takes much time for the heat to reach the copy medium P from such material. Moreover, such material is very poor in thermal efficiency. In FIG. 1, reference numerals 5 and 5' designate rollers for transporting the copy medium P, and BL denotes a blast pressure for bringing the copy medium into intimate contact with the heating member.

Another known construction is the roller-shaped heating-fixing device as shown in FIG. 2. Fixation is accomplished by the copy medium P being held and passed between two heating rollers 6 and 6' rotating in the direction of arrow. Each of these heating rollers 6, 6' comprises a shaft 7, a heating element 8 and a heat-conductive cylinder 9, and a layer of air 10 having a high specific heat is provided between the heating element 8 and the heat-conductive cylinder 9 to electrically insulate them from each other. This has resulted in bad heat conduction, that is, the heat supplied from the heating element 8 to the heat-conductive cylinder 9 has been only the radiant heat, which has meant a very low thermal efficiency.

SUMMARY OF THE INVENTION

It is an object of the present invention to provide a heating-fixing device which has a uniform temperature distribution on the heat-emitting surface.

It is another object of the present invention to provide an improved heating-fixing device which has a high heating speed after the closing of the main switch of the device.

It is still another object of the present invention to provide a compact heating-fixing device which is also good in thermal efficiency.

It is yet another object of the present invention to provide a heating-fixing device which effects the heating without causing irregular fixation.

These objects and other features of the present invention will become more fully apparent from the following detailed description of the invention taken in conjunction with the accompanying drawings.

DESCRIPTION OF THE PREFERRED EMBODIMENTS

Figure 1:
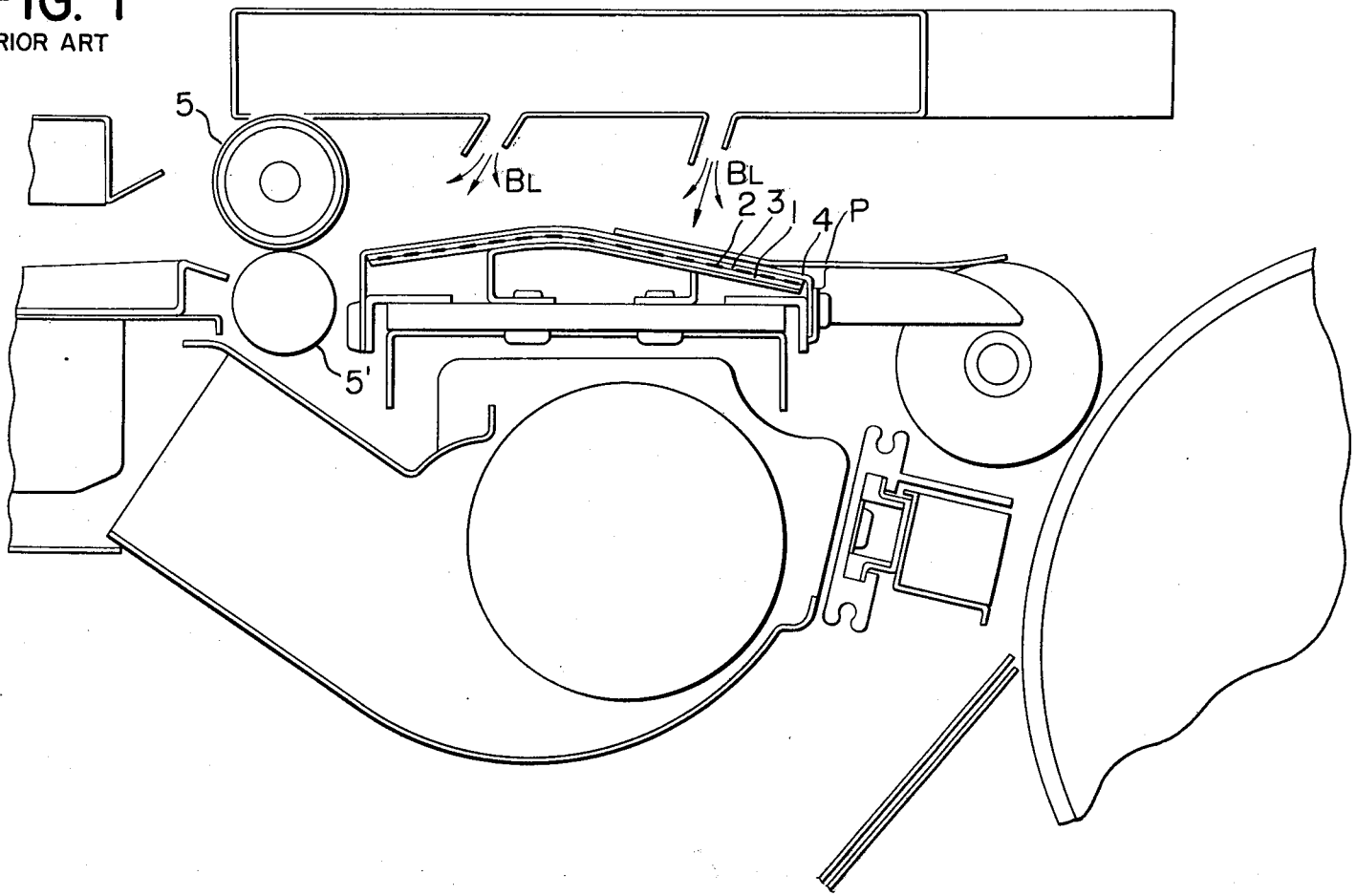
FIG. 1 PRIOR ART
FIGS. 1 and 2 show the heating-fixing devices according to the prior art.
Figure 2:
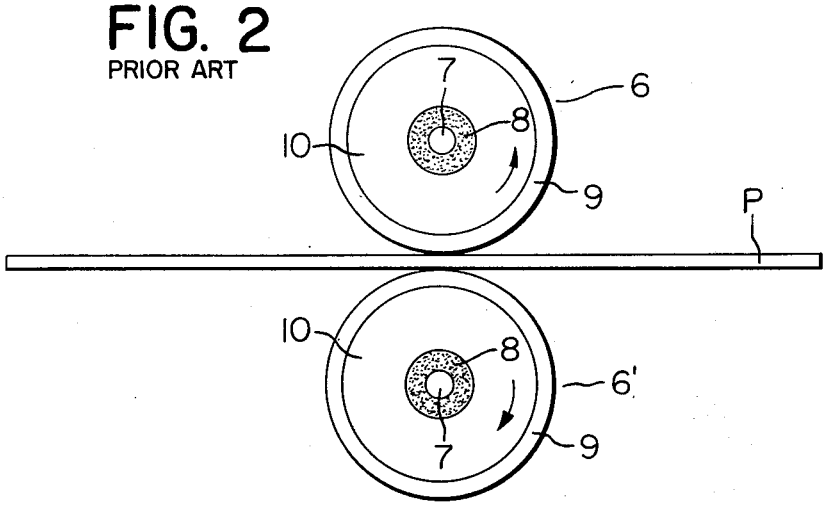
FIG. 2 PRIOR ART
Figure 3A:
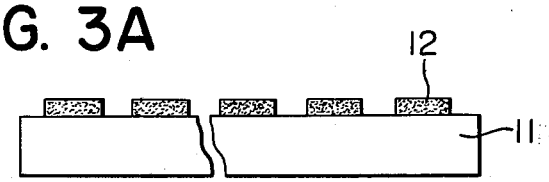
FIGS. 3A, 3B and 3C are schematic, cross-sectional views of the essential construction of heating members used in the heating-fixing device of the present invention.

Referring first to FIGS. 3(A), (B) and (C), there is illustrated the principle of the construction of the heating member applicable to the heating-fixing device of the present invention.

Figure 3B:
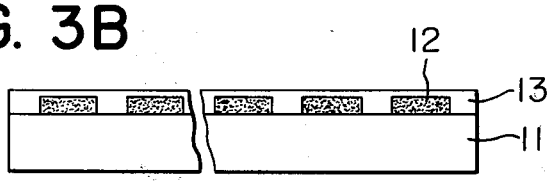
Figure 3C:
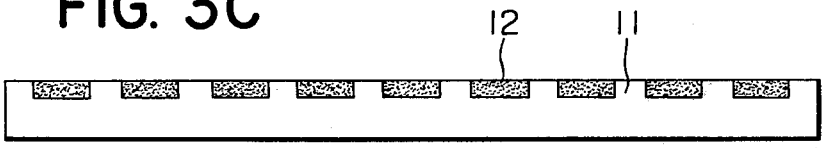

In FIGS. 3(A), (B) and (C), reference numeral 11 designates a heat-resistant, insulative substrate and reference numeral 12 denotes a heating element which forms a heating circuit as shown in FIGS. 3(A), 3(B) or 3(C). The heating member is constituted by these. FIG. 3(A) shows a form of the heating member in which heating element 12 is simply placed on the substrate 11. FIG. 3(B) shows another form of the heating member in which an ultra-thin protective film layer (about 30 $\mu$) 13 is provided over the heating element to prevent oxidation of the latter. The ultra-thin protective film layer 13 may preferably be one of low surface energy coated with a thin film of heat-resistant, low surface tension material for further preventing contamination of the layer which would result from developer or the like being deposited thereon, or a layer having a low coefficient of friction for reducing friction between the copy medium and the heating element. As such a thin layer, it has been found that one which is coated with heat-resistant silicone (not straight chain siloxane) at about 2000A does not permit deposition of developer thereon, and experiences no oxidation or degeneration of the heating element even after 500 hours of electrical energization. FIG. 3(C) shows still another form of the heating member in which the heating element 12 is embedded within the heat-resistant, insulative substrate 11. In FIG. 3(C), the above-described thin film layer 13 may also be provided over the heating element 12.

Figure 4A:
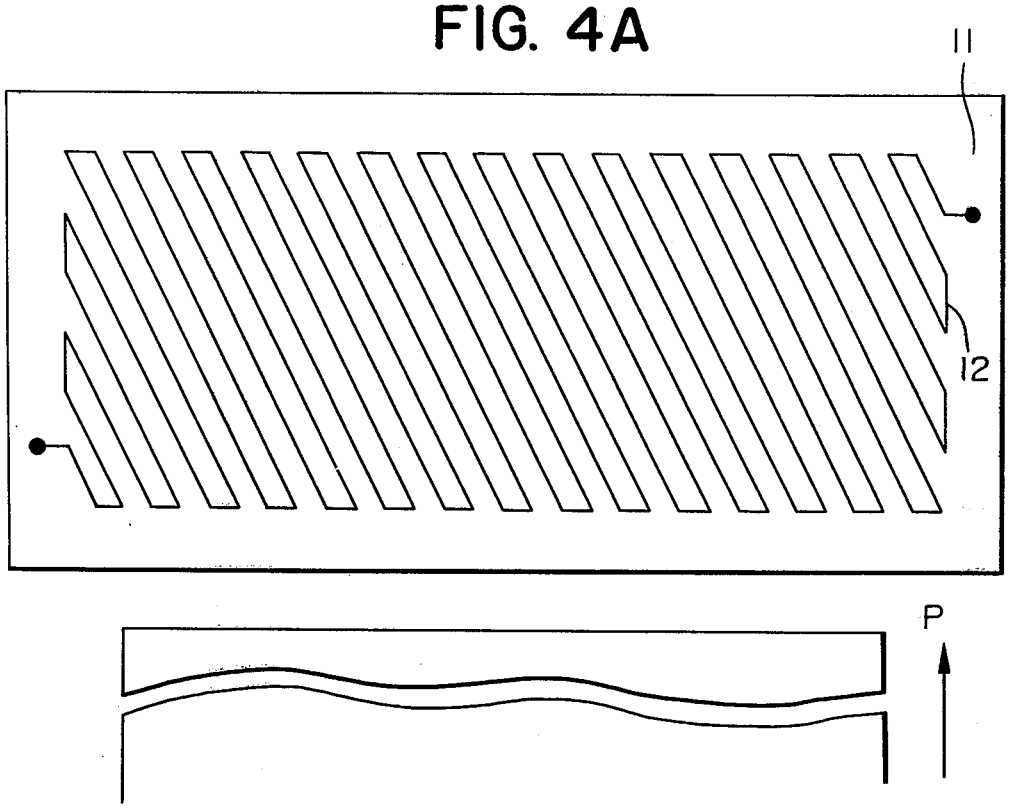
FIGS. 4A, 4B and 4C show various arrangements of a heating element for use in the heating member of the present invention.

FIGS. 4(A), (B) and (C) show basic constructions of the heating-fixing device according to the present invention, wherein the heating member may be in the form of an obtusely V-shaped, flat plate or other plate having otherwise curved surfaces. Where the heating element is the above-described heating element 12 laminated on the substrate 11, and if the heating element 12 is arranged in orthogonal relationship with the direction of movement of copy paper, the paper may wave in its direction of movement. In view of this, as shown in FIGS. 4(A), (B) and (C), the heating element 12 is so arranged that it is contacted by the paper at a certain angle with the direction of movement of the latter. By doing so, the above-noted irregular fixation of like phenomenon may all be avoided.

While a sufficient fixing effect can be achieved by the device comprising a single heating plate as described, a better effect may be obtained if the device is constituted by two heating plates so that the heating elements of the heating plates face each other with the path of paper therebetween.

Figure 5A:
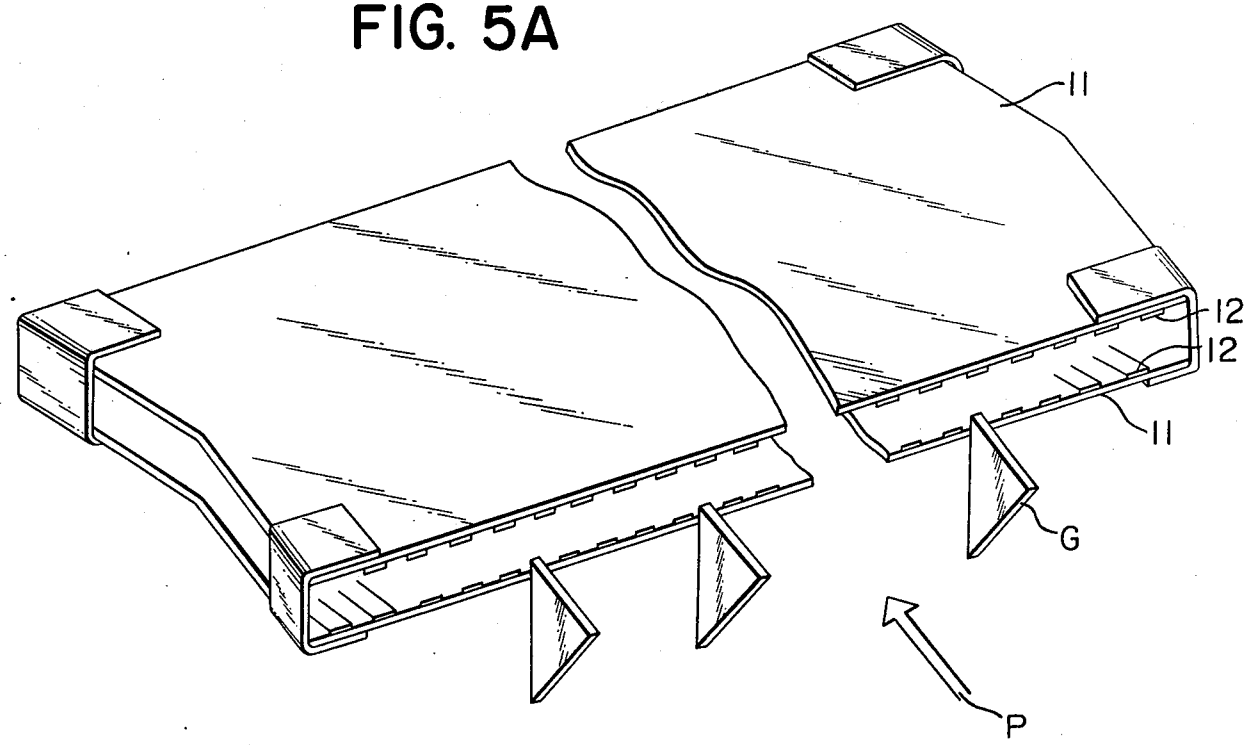
FIGS. 5A and 5B illustrate the configuration of heating chambers utilizing the heating elements of the invention.
Figure 5B:
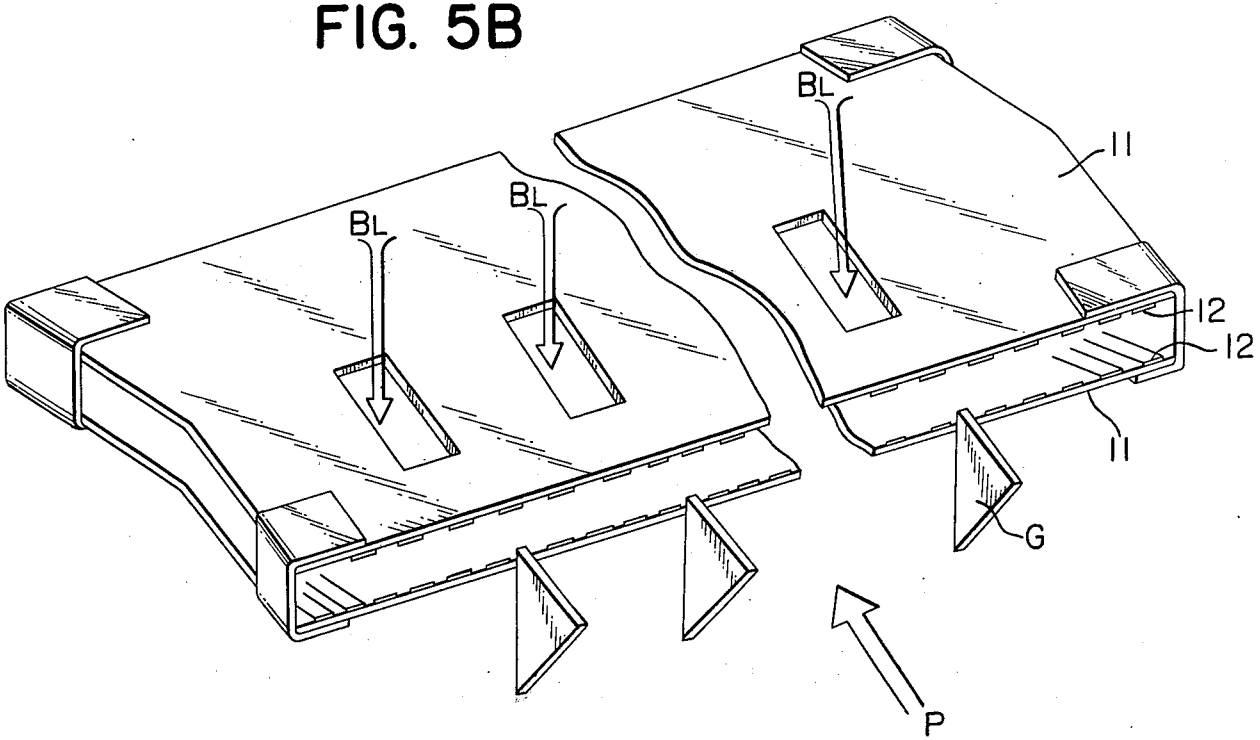

Reference will now be had to FIGS. 5(A) and (B). A sheet of copy paper P with an image formed thereon by toner is guided by guide plates G and, when the paper enters the chamber between the plates each comprising the substrate 11 and the heating elements 12, the paper is heated by the heating elements 12 from above and below, thus obtaining a very good effect. Further, the upper and lower surfaces being covered with an adiabatic material contributes to quick rising of heat and a less amount of heat outwardly discharged, which also leads to a better effect obtained by a smaller electric power. FIG. 5(B) shows an arrangement in which the upper heating plate constituted by substrate 11 and heating element 12 is slotted at desired locations thereof so that an air flow may pass downwardly through the slots to provide a better contact of the paper with the lower heating plate. If the air flow supplied downwardly is circulated by lateral suction or by natural convection, still a better effect may be obtained.

Figure 6A:
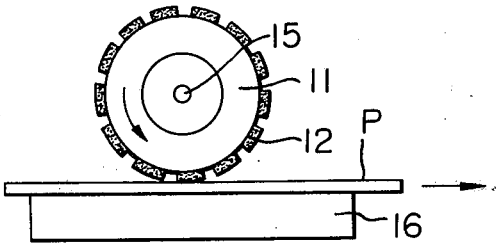
FIGS. 6A and 6B illustrate embodiments of the heating member in the form of rollers.

FIGS. 6(A) and (B) shows examples of the heating member of the present invention which is in the form of roller. Of course, the constructions of the heating member as shown in FIGS. 3(B) and (C) are again applicable to these examples. In these figures, reference numeral 15 designates the shaft of the heating roller, and reference numeral 11 denotes the heat-resistant, insulative substrate which is herein shown in a cylindrical shape. Designated by 12 is the heating element. By being rotated in the direction of the arrow, the heating element heats and fixes the copy medium P on a support plate 16 while transporting the copy medium in the direction of the arrow.

Figure 6B:
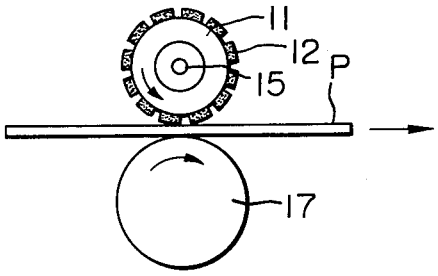

FIG. 6(B) shows an arrangement in which the support plate 16 shown in FIG. 6(A) is replaced by a rotatable roller 17, which may also be a heating roller to provide a better effect.

Figure 7A:
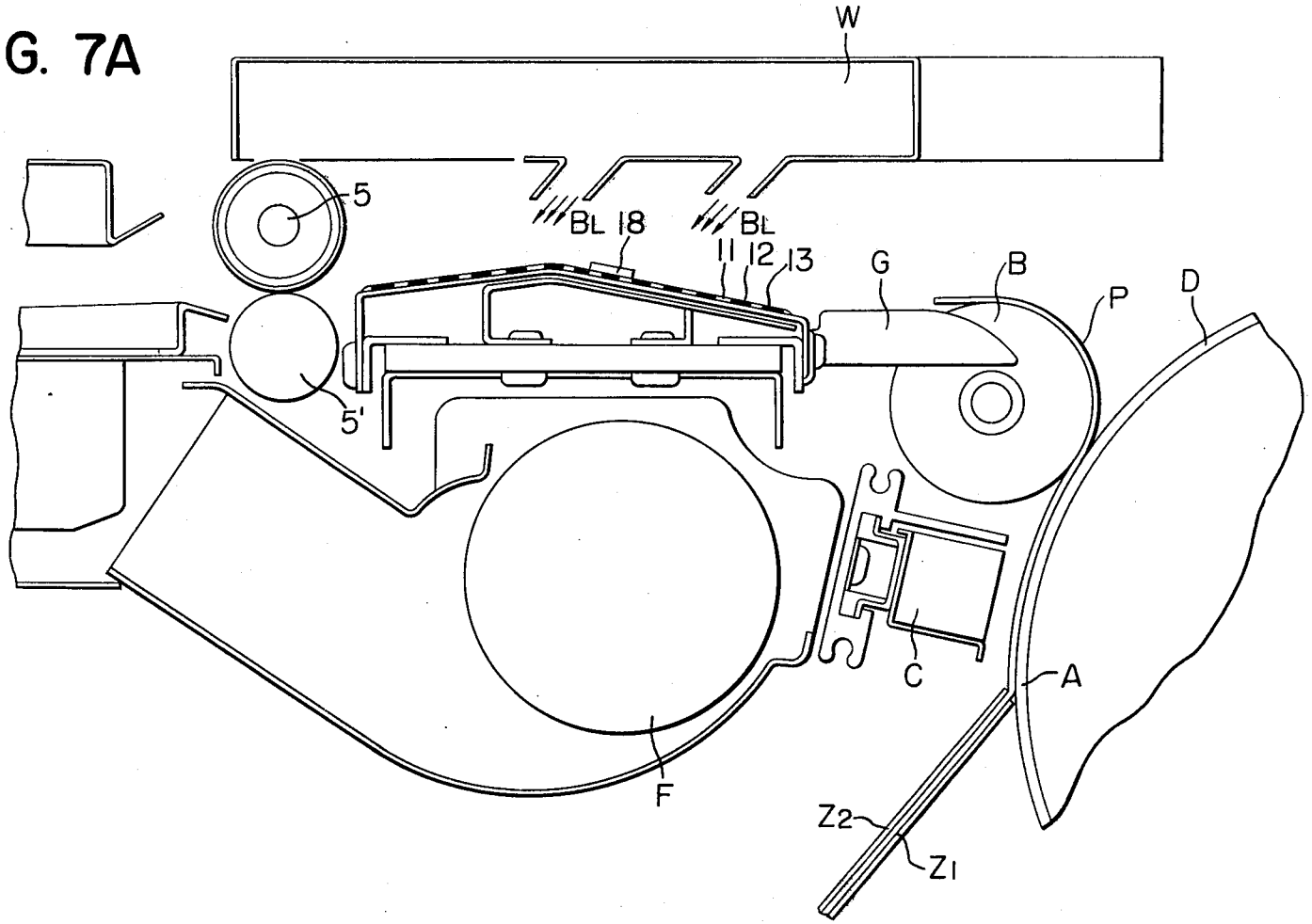
FIGS. 7A and 7B show cross-sectional views of the apparatus embodying the invention.

FIGS. 7(A) and (B) show specific embodiments of the heating-fixing device in a copying machine. FIG. 7(A) is a cross-sectional view of such device using a single heat plate, and FIG. 7(B) is a similar view of the device using two heating plates opposed to each other.

Referring to FIG. 7(A), a toner image is formed on a photosensitive drum D through the steps of charging, exposure and development, and a transfer medium (paper) is fed from a container from transfer medium P in timed relationship with the photosensitive drum D and passed between guides Z1 and Z2 and into contact with the drum D at a point A, whereafter the transfer medium P is electrostatically charged by a charger (C) as required, and then separated from the drum surface by a separator roller B. A desired toner image is formed on the paper, and the paper advances into a fixing station for melting the toner image. By a guide G, the transfer medium P is guided onto a heating plate comprising the substrate 11, heating element 12 and protective film layer 13. The heating plate is maintained at a required temperature (about 200° C) by a control circuit which will hereinafter be described. By the above-mentioned temperature, the toner is completely melted to fix H on the paper and thus provide a complete copy, which is discharged outwardly through discharge rollers 5, 5'. A blast pressure BL is applied toward the heating plate by a fan motor or the like and through a wind path W. This serves to bring the paper into completely intimate contact with the heating plate. A fan F is used for ventilation.

Figure 7B:
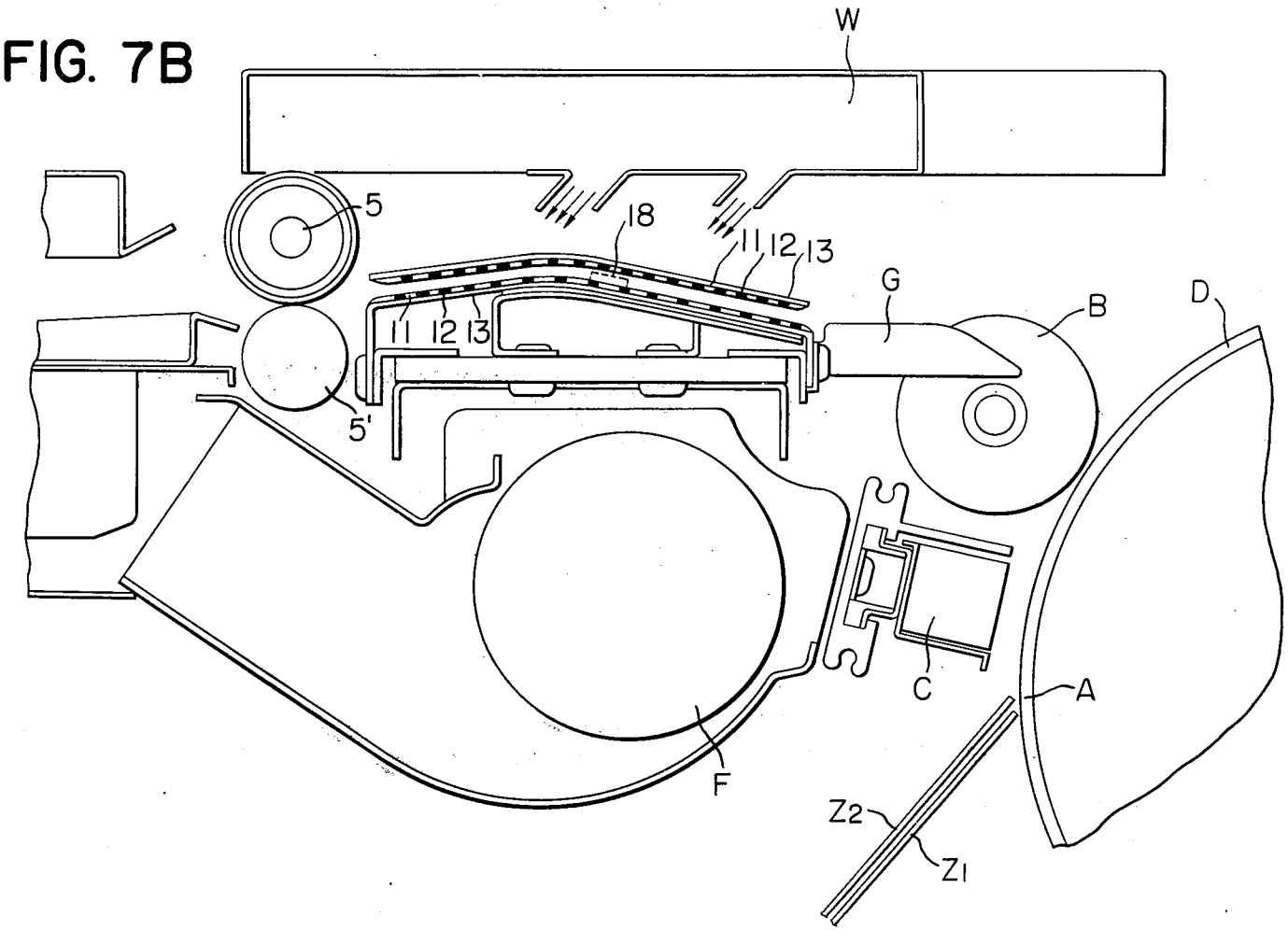
Figure 8:
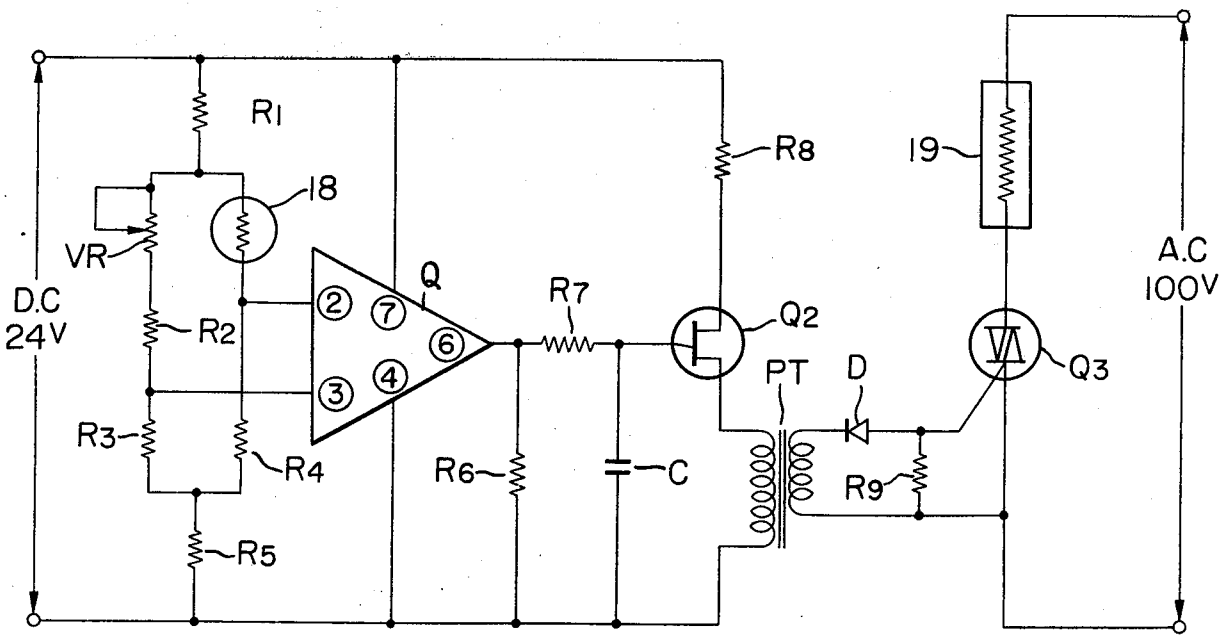
FIG. 8 schematically illustrates a circuit for energizing the heating members of the invention.

FIG. 7(B) is a cross-sectional view of the FIG. 5(A) device as it is actually used, and is similar to FIG. 7(A) in the other points. FIG. 8 shows the circuit for controlling the surface temperature of the heating plates shown in FIGS. 7(A) and (B).

The surface temperature of the heating plates is detected by a thermosensitive element 18 provided thereon. By the copy medium P passing on the heating member of the so constructed heating-fixing device, the developer on the copy medium is heated and fixed, but in order that the heating-fixation may be done always under a predetermined condition, the surface temperature of the heating member in the heating-fixing device must be maintained constant by the control circuit as shown in FIG. 8. This control circuit is such that the thermosensitive element 18 provided on the heating member varies its resistance value with its temperature variation and the variation in the resistance value is amplified to turn on or off a resistance heating element 19 to thereby maintain a required temperature.

More specifically, when the temperature detected at the temperature detecting position is below a required level, the resistance balance of a bridge circuit comprising a variable resistor Vr, fixed resistors R2, R3, R4 and thermistor 18 is destroyed so that a potential difference is produced between the input terminals 2 and 3 of a differential amplifier Q1, whereby the differential amplifier Q1 is energized with its output terminal 6 assuming a high level, and a capacitor C is thus charged through a fixed resistor R7. Subsequently, oscillation is effected by a unijunction transistor (UJT) Q2, fixed resistor R7 and capacitor C and the output thereof is passed through a pulse transformer PT to the gate of a triac Q3, which is thus turned on to energize the resistance heating element 19, thereby heating the heating member. When the heating member is sufficiently heated to a predetermined temperature or above, the resistance of the thermosensitive element 18 attached to the heating member falls to balance the resistance of the bridge circuit to thereby nullify the potential difference between the input terminals two and three and deenergize the differential amplifier Q1, so that the oscillation of the oscillating circuit comprising the capacitor C and the unijunction transistor (UJT) Q2 is stopped to nullify the gate input of the triac Q3, which is thus turned off to stop heating the resistance heating element 19 and accordingly discontinue the temperature rise.

The ON-OFF control effected by the above-described electric circuit maintains the desired surface temperature of the heating member.

Procedures for use in making the heating member will hereinafter be described. The heating member may have the circuit therein formed as by etching or pressing a conductor having a resistance for providing a prescribed temperature, or as by printing a conductor having a required resistance. Further, if metal foil, for example, is used as the conductor having a resistance, or if use is made of a conductor in the form of thin film having a resistance formed by evaporating a metal oxide or a metal compound, then the thickness, width, area, volume or other factor of such conductor may be necessary to thereby provide a prescribed wattage and accordingly, a prescribed temperature. In these cases, no particular circuit path may be required and a film-shaped material may directly be used as the heating member.

Figure 4B:
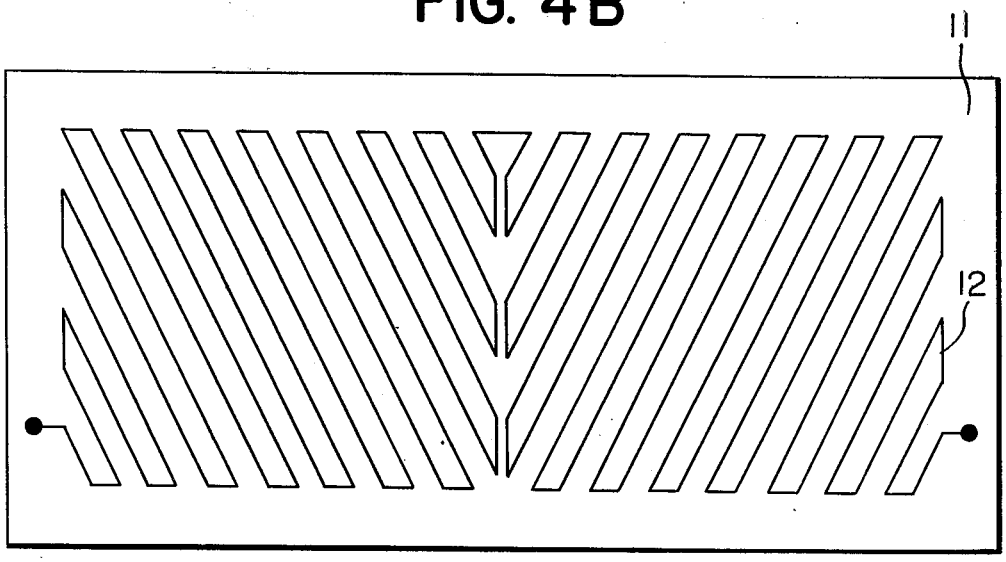
Figure 4C:
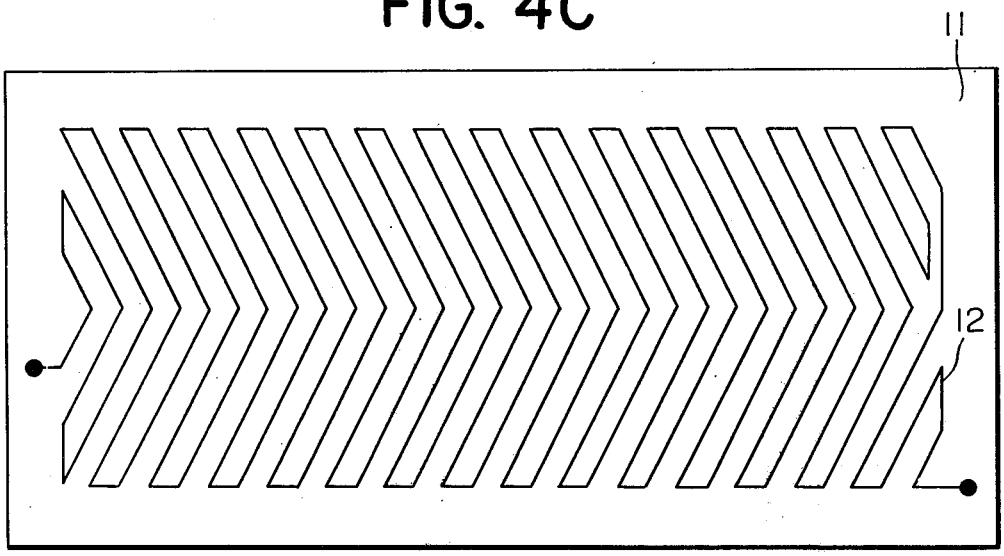

As to the embodiment shown in FIG. 4, the substrate employed was a thermosetting silicone resin which could withstand continuous use at or below 350° C in a coated cloth (Prepreg) consisting of silicone resin reinforced by glass cloth (for example, KMC-300, tradename, produced and sold by shin-etsu Kagaku K.K.), and foil of SUS-27 having a thickness of 50 $\mu$ was employed as the heating element. A heat-resistant adhesive was interposed between the substrate and the heating element, and the assembly was preheated at 100° to 120° C for 1 to 3 minutes. Thereafter, male and female metal molds for obtaining the heating member shown in FIG. 4(A) were prepared and within the molds, the material was heated at 195° C for three minutes, and then compressed and shaped under a shaping pressure of 185 kg/cm$^2$. Thereafter, the assembly was subjected to post-cure at 250° C for 2 hours. Thereafter, in order to obtain a circuit of the heating element, the SUS-27 portion was etched and thus, a heating circuit was obtained. The heating circuit of SUS-27, lead wires, and heating circuit pattern were connected together by welding.

Comparing the present invention with the prior art method, the latter method requires several minutes for the heating member to attain the prescribed temperature because an insulating layer and a heating plate intervene between the heating element and the copy medium, whereas according to the heating-fixing device of the present invention the direct contact of the heating element with the copy medium enables the heating member to attain the prescribed temperature in a moment to thereby complete the fixation. In this manner, the heating-fixing device of the present invention momentarily attains the prescribed temperature required for heating and fixation, and this reduces the waiting time between the closing of the main switch and the initiation of high-speed copying. Moreover, the good thermal efficiency of the inventive device enables the fixation to be achieved by a lower wattage. Thus, the present invention provides a heating-fixing device which is light in weight and highly excellent in performance.

What is claimed is:

1. A heating-fixing device for fixing a developed electrophotographic image comprising:

a pair of heating members, each including a heat-resistant, insulative substrate and a heating element provided on said substrate, said heating elements being opposed to each other with a path for a copy material having a developed image thereon being interposed therebetween, wherein said heating elements are coated with a thin film of a material having a high heat resistance and a low coefficient of friction, and further comprising means for imparting an air flow to bring the copy material into contact with one of said two heating members.

2. A heating-fixing device according to claim 1, wherein said heating members are planar.

3. A heating-fixing device according to claim 1, wherein at least one of said heating members is in the form of a roller.

4. A heating-fixing device according to claim 1, wherein at least one of said heating elements is embedded within said substrate.

5. A heating-fixing device for fixing a developed electrophotographic image comprising:

a pair of heating members, each including a heat-resistant, insulative substrate and a heating element provided on said substrate, said heating elements being opposed to each other with a path for a copy material having a developed image thereon being interposed therebetween, wherein one of said heating members is formed with openings and further comprising means for imparting an air flow through said openings to bring the copy material into contact with one of said two heating members.

6. A heating-fixing device according to claim 1, wherein each of said heating elements in said heating members are arranged obliquely with respect to the direction of movement of the member to be heated.

* * * * *